US010493999B2

(12) United States Patent
Sano et al.

(10) Patent No.: US 10,493,999 B2
(45) Date of Patent: Dec. 3, 2019

(54) RAILCAR HEAD STRUCTURE

(71) Applicant: KAWASAKI JUKOGYO KABUSHIKI KAISHA, Hyogo (JP)

(72) Inventors: Atsushi Sano, Kobe (JP); Naoaki Kawakami, Kobe (JP); Naohiro Yoshida, Kobe (JP); Shinichiro Hata, Kobe (JP); Seiichiro Yagi, Akashi (JP); Masayuki Tomizawa, Akashi (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 678 days.

(21) Appl. No.: 14/908,632

(22) PCT Filed: Jul. 17, 2014

(86) PCT No.: PCT/JP2014/003811
§ 371 (c)(1),
(2) Date: Jan. 29, 2016

(87) PCT Pub. No.: WO2015/015748
PCT Pub. Date: Feb. 5, 2015

(65) Prior Publication Data

US 2016/0167679 A1 Jun. 16, 2016

(30) Foreign Application Priority Data

Aug. 1, 2013 (JP) ..... 2013-160094

(51) Int. Cl.
*B61D 15/06* (2006.01)
*B61D 17/06* (2006.01)
(Continued)

(52) U.S. Cl.
CPC ..... *B61D 15/06* (2013.01); *B61D 17/005* (2013.01); *B61D 17/06* (2013.01); *B61D 17/02* (2013.01)

(58) Field of Classification Search
CPC . B61D 1/00; B61D 1/06; B61D 13/00; B61D 13/02; B61D 15/00; B61D 15/06; B61F 1/00; B61F 1/08; B61F 1/10
See application file for complete search history.

(56) References Cited

U.S. PATENT DOCUMENTS 5,579,699 A 12/1996 Dannawi et al.
5,715,757 A 2/1998 Dannawi et al.
(Continued)

FOREIGN PATENT DOCUMENTS

FR 2712950 A1 6/1995
JP 2007-302081 A 11/2007
(Continued)

OTHER PUBLICATIONS

International Search Report—PCT/JP2014/003811 dated Oct. 21, 2014.
(Continued)

*Primary Examiner* — Robert J McCarry, Jr.
(74) *Attorney, Agent, or Firm* — Studebaker & Brackett PC

(57) ABSTRACT

A railcar head structure includes: a roof bodyshell positioned above a driver's cab window; and an underframe. The underframe includes: a pair of side sills; and a center sill located between the side sills and extending in a car longitudinal direction. A collision post is erected on a tip end of the center sill. A pillar is provided at the driver's cab window and extends so as to divide the driver's cab window. The pillar includes one end joined to the collision post and the other end joined to the roof bodyshell and couples the roof bodyshell and the collision post to each other.

8 Claims, 5 Drawing Sheets

(51) Int. Cl.
*B61D 17/00* (2006.01)
*B61D 17/02* (2006.01)

(56) References Cited

U.S. PATENT DOCUMENTS

| | | | | |
|---|---|---|---|---|
| 7,536,958 | B2 * | 5/2009 | Bravo | B61C 17/04 105/340 |
| 2007/0261591 | A1 | 11/2007 | Bravo et al. | |
| 2008/0250965 | A1 | 10/2008 | Clark et al. | |
| 2012/0097066 | A1 | 4/2012 | Matsuoka et al. | |

FOREIGN PATENT DOCUMENTS

| | | | |
|---|---|---|---|
| JP | 2009-262839 | A | 11/2009 |
| JP | 2010-254122 | A | 11/2010 |
| JP | 2012-502833 | A | 2/2012 |
| JP | 2013-28291 | A | 2/2013 |
| WO | 2010109891 | A1 | 9/2010 |
| WO | 2013/080367 | A1 | 6/2013 |

OTHER PUBLICATIONS

Written Opinion—PCT/JP2014/003811 dated Oct. 21, 2014.
International Preliminary Report on Patentability of the International Searching Authority; PCT/JP2014/003811 dated Feb. 2, 2016.
The First Office Action issued by the State Intellectual Property Office of the People's Republic of China dated Oct. 10, 2016, which corresponds to Chinese Patent Application No. 201480027008.5 and is related to U.S. Appl. No. 14/903,632; with English language translation of search report.
Search Report issued by Taiwan Patent Office; which corresponds to TW 103125657 and corresponds to U.S. Appl. No. 14/903,632; with English language translation.

* cited by examiner

RAILCAR HEAD STRUCTURE

TECHNICAL FIELD

The present invention relates to a railcar head structure for protecting a crew space of a driver's cab.

BACKGROUND ART

A railcar has been designed so as to be divided into a crushable zone and a survival zone. The crushable zone is a railcar head portion which absorbs collision energy. The survival zone is a high strength portion which secures a survival space even in collision.

The crushable zone includes a driver's cab in some cases. Therefore, to protect a crew space of the driver's cab, an increase in stiffness of the driver's cab has been proposed in recent years. For example, PTL 1 discloses a railcar 100 shown in FIGS. 5A and 5B.

Specifically, in the railcar 100, an underframe 111, side bodyshells 112, and a roof bodyshell 113 constitute a high strength portion 110, and a flying object prevention plate 120 is arranged in front of the high strength portion 110. The driver's cab is formed between the flying object prevention plate 120 and the high strength portion 110. Both end portions of the flying object prevention plate 120 in a car width direction are firmly coupled to the respective side bodyshells 112 by first horizontal beam members 131, second horizontal beam members 132, and inclined beam members 133.

The flying object prevention plate 120 includes openings. Energy absorbing members 140 penetrate the flying object prevention plate 120 through the openings. Therefore, in the collision, only the energy absorbing members 140 are crushed, and the crew space of the driver's cab is maintained.

CITATION LIST

Patent Literature

PTL 1: Japanese Laid-Open Patent Application Publication No. 2007-302081

SUMMARY OF INVENTION

Technical Problem

However, the structure shown in FIGS. 5A and 5B is such that a driver's cab window has a three-surface shape constituted by: a front surface portion located between the left and right inclined beam members 133; and side surface portions each located between the inclined beam member 133 and the second horizontal beam member 132, corners of the three-surface shape being right-angled. Therefore, in a case where the driver's cab window has, for example, a curved shape that is smoothly convex toward a front side, it is difficult to adopt the structure shown in FIGS. 5A and 5B. Typically, the underframe has the highest strength in the railcar. Therefore, to secure the crew space in the collision, it is desirable to directly transmit a collision load to the underframe.

An object of the present invention is to provide a railcar head structure capable of, even in a case where the driver's cab window has the curved shape, protecting the crew space of the driver's cab while utilizing the underframe and the roof bodyshell.

Solution to Problem

To solve the above problem, a railcar head structure of the present invention includes: an underframe including a center sill extending in a car longitudinal direction; a collision post erected on a tip end of the center sill; a roof bodyshell positioned above a driver's cab window; and a pillar extending so as to divide the driver's cab window, including one end joined to the collision post and the other end joined to the roof bodyshell, and coupling the roof bodyshell and the collision post to each other.

According to the above configuration, the center sill, the collision post, the pillar, and the roof bodyshell form a continuous U-shaped structure surrounding a crew space of the driver's cab. Therefore, the driver's cab can obtain high stiffness and effectively protect the crew space.

Advantageous Effects of Invention

The present invention can provide the railcar head structure capable of, even in a case where the driver's cab window has, for example, the curved shape, protecting the crew space of the driver's cab while utilizing the underframe and the roof bodyshell.

DESCRIPTION OF EMBODIMENTS

Figure 1:
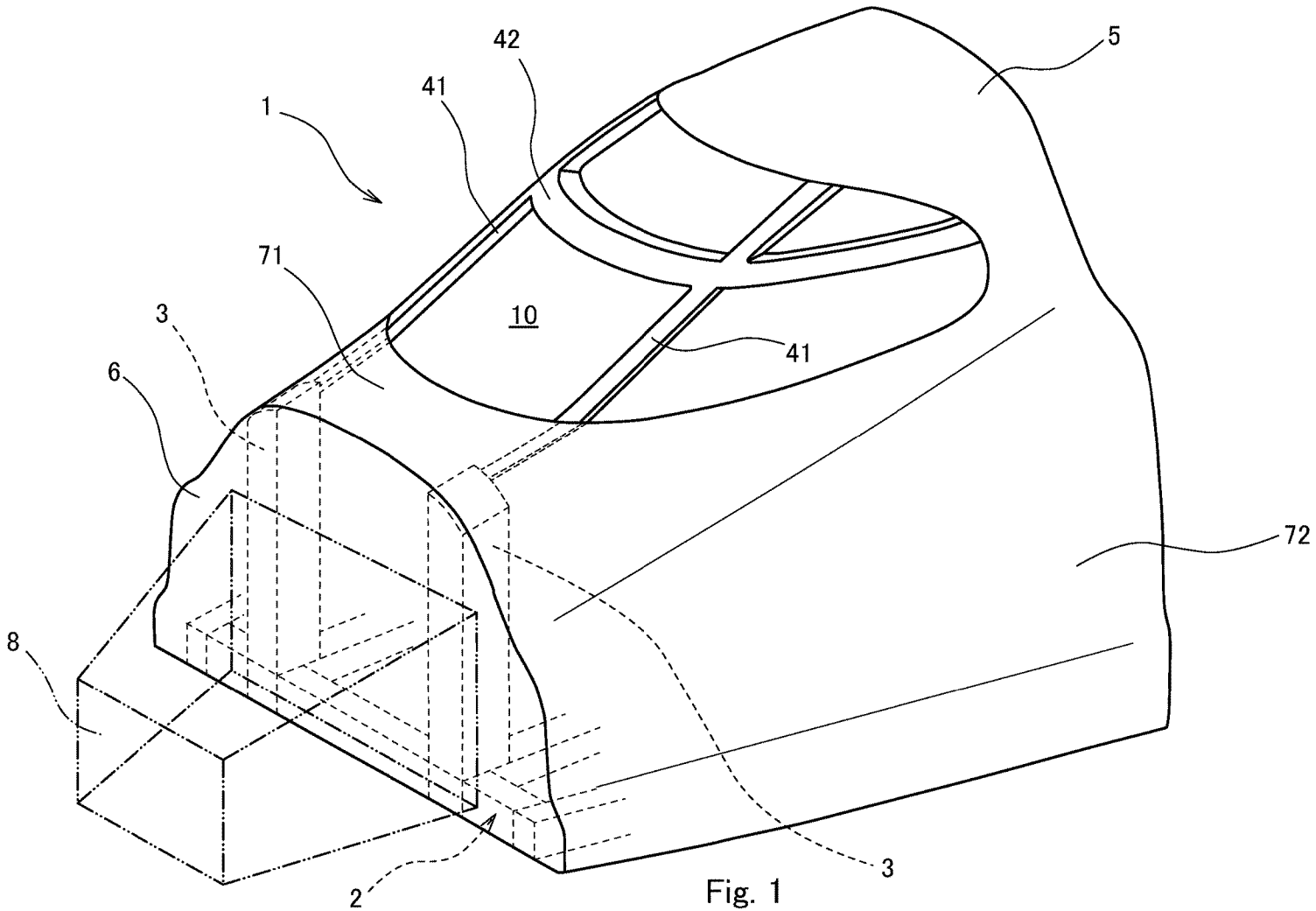
FIG. 1 is a perspective view of a railcar in which a head structure according to one embodiment is adopted.
Figure 2:
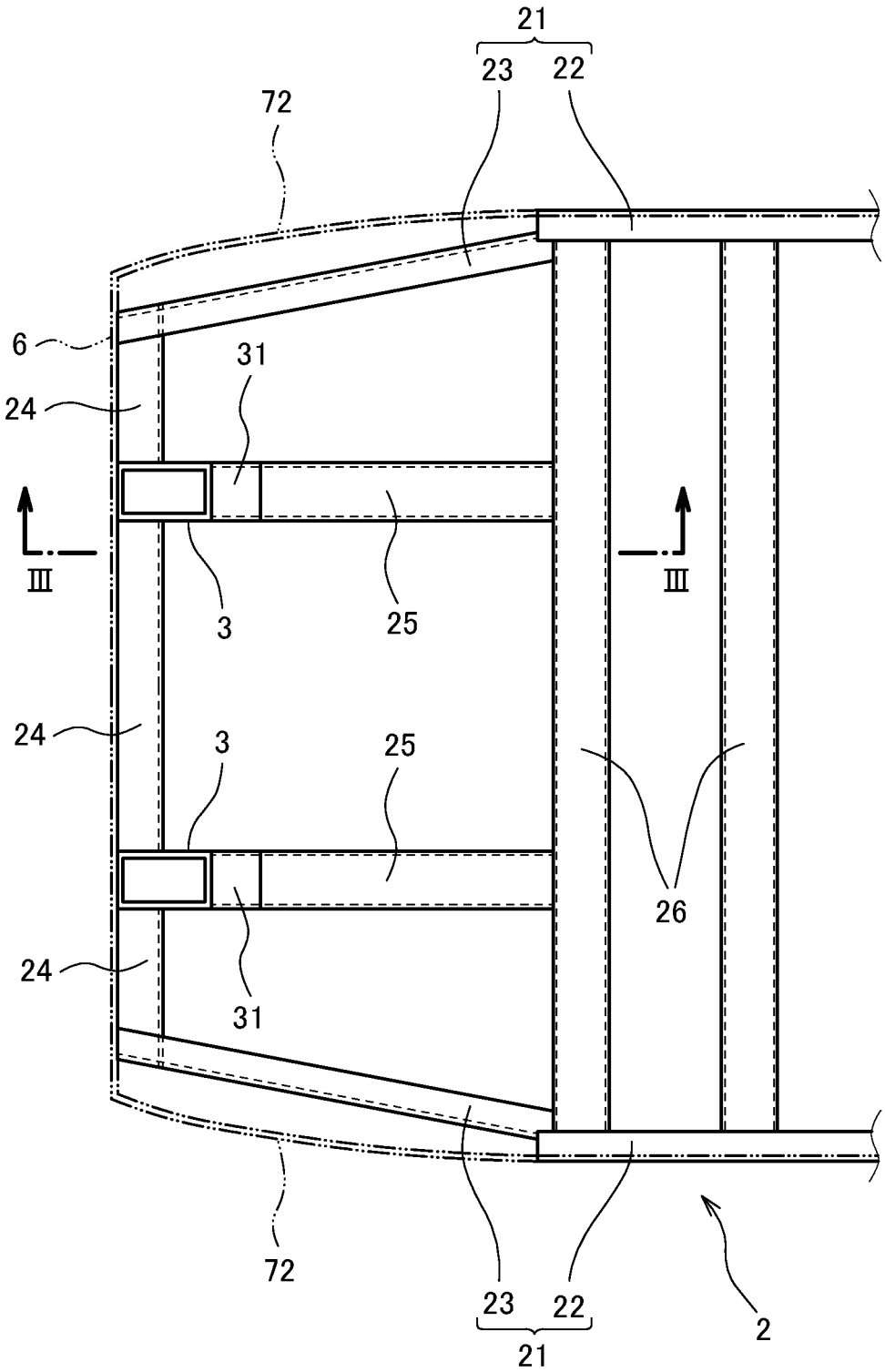
FIG. 2 is a plan view of an underframe of the railcar shown in FIG. 1.
Figure 3:
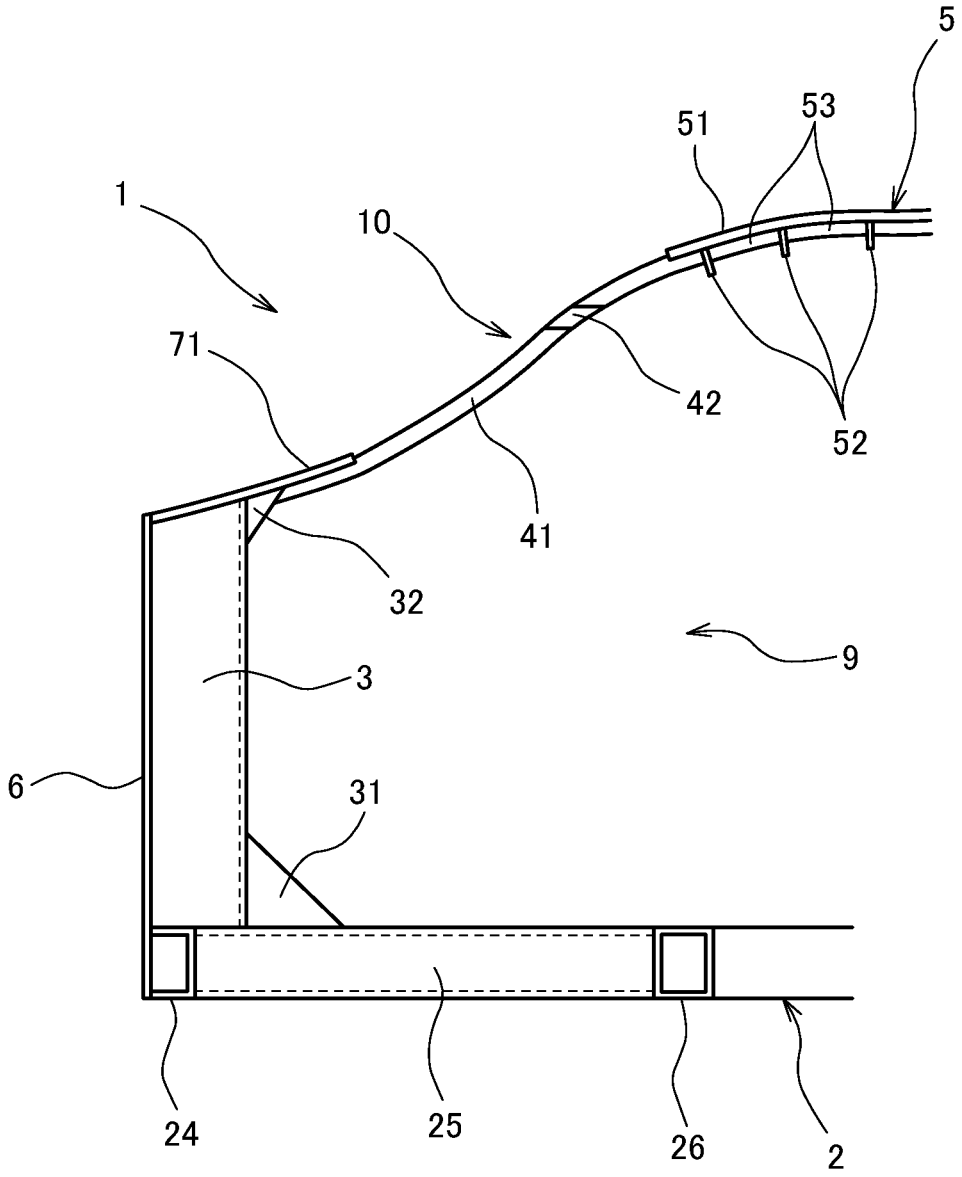
FIG. 3 is a cross-sectional view taken along line III-III of FIG. 2.

FIGS. 1 to 3 show a railcar 1 in which a head structure according to one embodiment is adopted. In the present embodiment, a high-speed car is assumed as the railcar 1, and the railcar 1 has a streamline shape that is pointed toward a tip end of the railcar 1. However, the shape of the railcar 1 is not limited to this.

Specifically, the head structure of the railcar 1 includes an underframe 2 and a roof bodyshell 5. A driver's cab 9 (see FIG. 3) is formed between the underframe 2 and the roof bodyshell 5. Side surface exterior members 72 are arranged at both respective car width direction sides of the driver's cab 9. A front surface wall 6 is arranged in front of the driver's cab 9.

The driver's cab 9 includes a driver's cab window 10 largely inclined relative to a vertical direction. To be specific, the roof bodyshell 5 is located above and behind the driver's cab window 10. The driver's cab window 10 has a curved shape that is smoothly convex toward a front side. In a plan view, the driver's cab window 10 has a U shape.

Two vertical pillars 41 and one horizontal pillar 42 are provided at the driver's cab window 10. Each of the vertical pillars 41 extends in a direction oblique relative to a car longitudinal direction so as to divide the driver's cab window 10 laterally. The horizontal pillar 42 extends in a U shape on a horizontal plane so as to divide the driver's cab window 10 vertically. In the present embodiment, each of the vertical pillars 41 and the horizontal pillar 42 is a solid rod-shaped member.

An upper surface exterior member 71 is arranged in front of the driver's cab window 10 (between the driver's cab window 10 and the front surface wall 6). Each of the side surface exterior members 72 extends along the upper surface exterior member 71 and the roof bodyshell 5 and constitutes a continuous wall surface together with the upper surface exterior member 71 and the roof bodyshell 5.

As shown in FIG. 3, the roof bodyshell 5 includes: an outer surface plate 51; and a plurality of transverse plates 52 and a plurality of longitudinal plates 53 which reinforce the outer surface plate 51. The side surface exterior member 72 is a thin plate. Although not illustrated, as with the outer surface plate 51 of the roof bodyshell 5, the side surface exterior member 72 is reinforced by a plurality of transverse frames and a plurality of longitudinal frames. The upper surface exterior member 71 is a thick plate.

The front surface wall 6 has a substantially semi-circular shape in a front view and includes a linear lower side and an upper side that curves while waving and connects both ends of the lower side to each other. A front end portion of the upper surface exterior member 71 and front end portions of the side surface exterior members 72 are joined to the upper side of the front surface wall 6 by welding.

As shown in FIG. 2, the underframe 2 includes a pair of left and right side sills 21 and a pair of front and rear bolster beams 26 coupling the side sills 21 to each other. Each of the side sills 21 is constituted by: a main sill 22 parallel to the car longitudinal direction; and an inclined sill 23 extending from a tip end of the main sill 22 and inclined inward in a car width direction. The inclined sill 23 is also joined to the front bolster beam 26.

Two center sills 25 extending in the car longitudinal direction are arranged between the inclined sills 23. In the present embodiment, a direction in which the center sill 25 extends is parallel to the car longitudinal direction. However, the direction in which the center sill 25 extends may be slightly inclined relative to the car longitudinal direction. A length of the center sill 25 is equal to a length of the inclined sill 23 in the car longitudinal direction.

Each of coupling members 24 couples tip ends of the center sills 25 to each other or couples the tip end of the center sill 25 and a tip end of the inclined sill 23 to each other. These coupling members 24 constitute an end beam of the underframe 2.

In addition to the above-described beams and sills, the underframe 2 may include various beams, sills, and members. For example, one or two vertical sills coupling the bolster beam and the end beam to each other may be arranged between the center sills 25, or transverse beams each coupling the center sills 25 to each other or coupling the center sill 25 and the inclined sill 23 may be arranged between the bolster beam and the end beam.

Collision posts 3 are erected on respective tip ends of the center sills 25. Each of the collision posts 3 extends from the center sill 25 to the upper surface exterior member 71 and supports the upper surface exterior member 71. The front surface wall 6 is joined to the collision posts 3 by welding and held by the collision posts 3. The front surface wall 6 is also joined to the underframe 2 by welding.

A collision energy absorbing device 8 is attached to the front surface wall 6 so as to project from the front surface wall 6 to the front side. The collision posts 3 are arranged so as to overlap the collision energy absorbing device 8 as seen from the car longitudinal direction. The collision energy absorbing device 8 can be attached by using bolts or mechanical fastening members equivalent to the bolts. For example, when using the bolts, the front surface wall 6 may be provided with screw holes. A cover made of, for example, fiber reinforced plastic may be attached to the front surface wall 6. With this, a good appearance and fluid performance can be realized.

A reinforcing member 31 having a substantially triangular shape in a side view is arranged at a corner between each collision post 3 and the corresponding center sill 25. A reinforcing member 32 which has a substantially triangular shape in a side view and is smaller than the reinforcing member 31 is arranged between each collision post 3 and the corresponding upper surface exterior member 71. Each of the vertical pillars 41 extends from the roof bodyshell 5 through the driver's cab window 10 along a lower surface of the upper surface exterior member 71 to the reinforcing member 32. In other words, the vertical pillar 41 extends so as to oppose the center sill 25 and couples the roof bodyshell 5 and the collision post 3 to each other via the reinforcing member 32. To be specific, one end of the vertical pillar 41 is joined to the collision post 3 via the reinforcing member 32, and the other end of the vertical pillar 41 is joined to the roof bodyshell 5.

As explained above, according to the head structure of the present embodiment, the center sills 25, the collision posts 3, the vertical pillars 41, and the roof bodyshell 5 form a continuous U-shaped structure surrounding the crew space of the driver's cab 9. Therefore, the driver's cab 9 can obtain high stiffness and effectively protect the crew space. In addition, since the center sills 25 are parts of the underframe 2, the driver's cab 9 can be constituted by utilizing the underframe 2.

It is preferable that the vertical pillar 41 joined to one end of the collision post 3 and the center sill 25 joined to the other end of the collision post 3 be located on a substantially same flat plane. However, the vertical pillar 41 and the center sill 25 may be positioned so as to be twisted from each other. The center sills 25, the collision posts 3, the vertical pillars 41, and the roof bodyshell 5 are only required to form a substantially U-shaped structure.

In the present embodiment, since the front surface wall 6 is held by the collision posts 3, the front surface wall 6 can be reinforced by utilizing the collision posts 3. Further, in the present embodiment, the collision energy absorbing device 8 is attached to the front surface wall 6, and the collision energy is absorbed by the collision energy absorbing device 8 arranged in front of the driver's cab 9. Therefore, deformation of the driver's cab 9 in the collision can be prevented. In addition, the railcar 1 can be easily repaired by replacing the collision energy absorbing device 8 after the collision.

Further, in the present embodiment, the collision posts 3 are arranged so as to overlap the collision energy absorbing device 8 as seen from the car longitudinal direction. Therefore, reaction force acting on the front surface wall 6 in the collision can be effectively dispersed to the underframe 2 and the roof bodyshell 5.

Further, in the present embodiment, since the upper surface exterior member 71 is supported by the collision posts 3, the upper surface exterior member 71 can be firmly supported by utilizing the collision posts 3.

Other Embodiments

Figure 4:
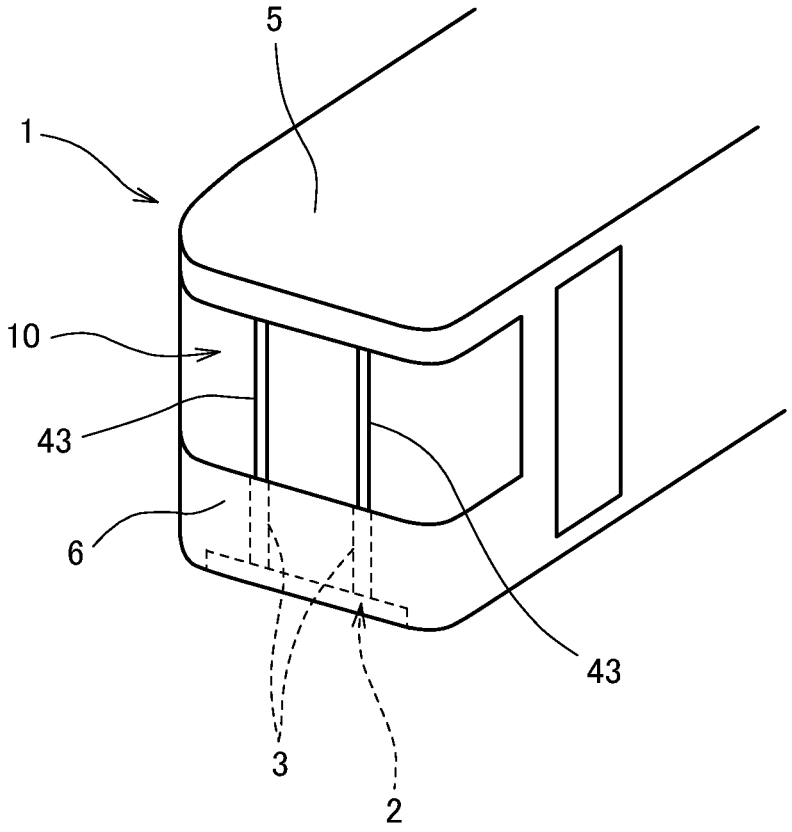
FIG. 4 is a perspective view showing the head structure of the railcar according to a modification example.
Figure 5A:
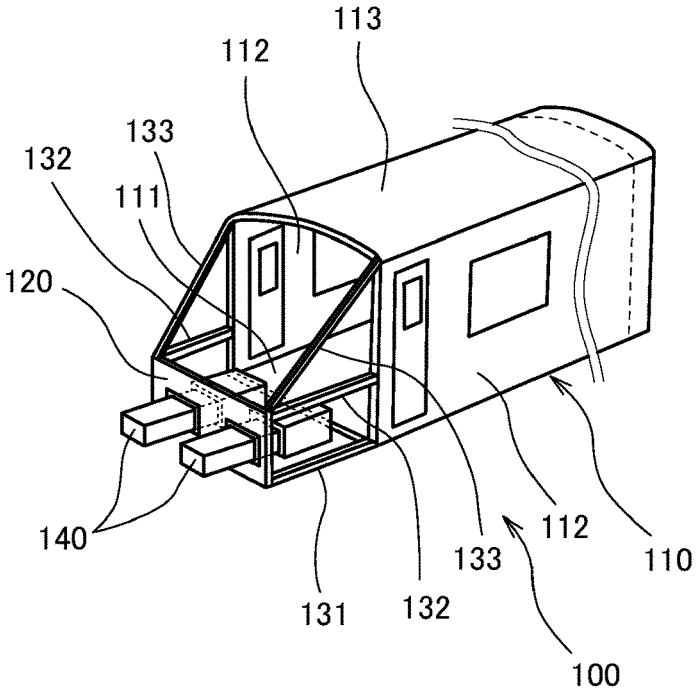
FIG. 5A is a perspective view of a conventional railcar.
Figure 5B:
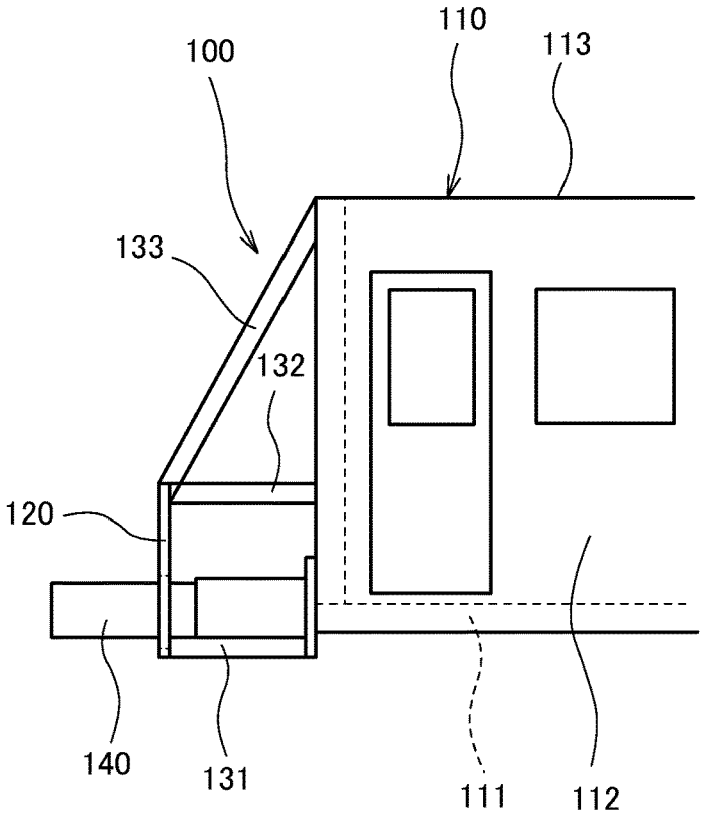
FIG. 5B is a side view of the conventional railcar.

The railcar 1 does not have to have the streamline shape that is pointed toward the tip end of the railcar 1. For example, as shown in FIG. 4, the railcar 1 may have a box shape whose front surface is parallel to the vertical direction.

In this case, the railcar 1 may include pillars 43 coupling the roof bodyshell 5 and the collision post 3 to each other and extending in the vertical direction.

The driver's cab window 10 does not have to be curved. For example, the driver's cab window 10 may have a substantially semi-octagonal shape in which an inclined surface portion inclined at 45° is formed between the front surface portion and the side surface portion.

The railcar 1 may be configured such that: the front surface wall 6 is omitted; and the collision energy absorbing device 8 is directly attached to the collision posts 3, or may be configured such that: the front surface wall 6 is provided with an opening; and the collision energy absorbing device 8 penetrates the front surface wall 6 through the opening.

Each of the vertical pillars 41 and the horizontal pillar 42 may be a hollow rod-shaped member. In a case where each of the vertical pillars 41 and the horizontal pillar 42 is a solid rod-shaped member as in the above embodiment, a field of view through the driver's cab window 10 can be widely secured by reducing the thickness of each of the vertical pillars 41 and the horizontal pillar 42.

INDUSTRIAL APPLICABILITY

The present invention is useful for railcars of various shapes.

REFERENCE SIGNS LIST

1 railcar
2 underframe
21 side sill
25 center sill
3 collision post
41 vertical pillar
42 horizontal pillar
5 roof bodyshell
6 front surface wall
8 collision energy absorbing device

The invention claimed is:

1. A railcar head structure comprising:
an underframe including
a beam extending in a car width direction and coupling a pair of side sills to each other and
a center sill connected to the beam and extending in a car longitudinal direction under a driver's cab;
a collision post erected on a tip end of the center sill;
a roof bodyshell positioned above a driver's cab window; and
a pillar extending so as to divide the driver's cab window, including one end joined to the collision post and the other end joined to the roof bodyshell, and coupling the roof bodyshell and the collision post to each other.

2. The railcar head structure according to claim 1, further comprising a front surface wall held by the collision post.

3. The railcar head structure according to claim 2, further comprising a cover attached to the front surface wall and made of fiber reinforced plastic.

4. The railcar head structure according to claim 1, wherein the pillar is a solid rod-shaped member.

5. The railcar head structure according to claim 1, wherein:
the driver's cab window is inclined relative to a vertical direction;
the roof bodyshell is positioned behind the driver's cab window; and
the pillar extends so as to oppose the center sill.

6. The railcar head structure according to claim 5, further comprising an upper surface exterior member arranged in front of the driver's cab window, wherein
the upper surface exterior member is supported by the collision post.

7. A railcar head structure comprising:
an underframe including a center sill extending in a car longitudinal direction;
a collision post erected on a tip end of the center sill;
a roof bodyshell positioned above a driver's cab window;
a pillar extending so as to divide the driver's cab window, including one end joined to the collision post and the other end joined to the roof bodyshell, and coupling the roof bodyshell and the collision post to each other;
a front surface wall held by the collision post; and
a collision energy absorbing device attached to the front surface wall so as to project from the front surface wall to a front side.

8. The railcar head structure according to claim 7, wherein the collision post is arranged so as to overlap the collision energy absorbing device as seen from the car longitudinal direction.

* * * * *